US006063157A

United States Patent [19]

Banerjee et al.

[11] Patent Number: 6,063,157

[45] Date of Patent: May 16, 2000

[54] PROCESS AND AN APPARATUS FOR REMOVAL OF SILICON, MANGANESE, CARBON AND SULFUR IN A SINGLE REACTION VESSEL

[76] Inventors: Shilowbhadra Banerjee, A-19, Chaitraban Residency, 127/2 ITI Rd., Aundh Pune-411007; Kedar Nath Pandey, B-14, Sail Township P.O:-Dhurwa, Ranchi-834004; Bharat Chandra Roy, A-115, Sail Township P.O:-Dhurwa, Ranchi-834004; Om Prakash Sharma, A-21, Sail Township P.O:-Dhurwa, Ranchi-834004; Asim Kumar Sahu, B-23, Sail Township P.O:-Dhurwa, Ranchi-834004, all of India

[21] Appl. No.: 08/965,145

[22] Filed: Nov. 6, 1997

[51] Int. Cl.[7] ..... C21C 7/04

[52] U.S. Cl. ..... 75/568; 266/216

[58] Field of Search ..... 75/500, 568, 569, 75/560; 266/216

[56] References Cited

U.S. PATENT DOCUMENTS

| | | | |
|---|---|---|---|
| 4,299,624 | 11/1981 | Miller et al. | 75/568 |
| 4,500,352 | 2/1985 | Else et al. | 75/568 |
| 4,943,411 | 7/1990 | Henych et al. | 75/568 |

*Primary Examiner*—Scott Kastler
*Attorney, Agent, or Firm*—Venable; George H. Spencer; Ashley J. Wells

[57] ABSTRACT

A process and an apparatus for removal of silicon, manganese, carbon and sulphur in a single reaction vessel from molten high carbon ferrous metal by conducting the highly reducing and highly oxidizing reactions at two different locations within the same reaction vessel. The removal of sulphur is effected at the bottom of the vessel, whereas the removal of manganese silicon and carbon is effected at the top layer of the molten layer of the molten metal where slag is present.

19 Claims, 3 Drawing Sheets

PROCESS AND AN APPARATUS FOR REMOVAL OF SILICON, MANGANESE, CARBON AND SULFUR IN A SINGLE REACTION VESSEL

BACKGROUND OF THE INVENTION

1. Field of the Invention

The present invention relates to an improved process for the removal of silicon, carbon, manganese and sulphur from molten high carbon farrous metal and an apparatus therefor. The invention particularly relates to an improved process for the pre-treatment of the molten hot metal, customarily produced in blast furnace, from which silicon, carbon, manganese and sulphur are removed all together in a reaction vessel such as a customary blast furnace or a transfer ladle used in a steel plant. In the process of the present invention, no re-lading or removal of the slag is involved till the desired removal of silicon, carbon, manganese and sulphur-all together from the hot molten high carbon farrous metal-is accomplished. Thus, the process of the present invention is operationally very simple and saves a significant amount of energy.

The iron oxides such as iron ores blue dust, mill scale, sinter returns etc. can be used. The fluxes such as lime, flourspar, and rice husk and the metallic magnesium either with or without aluminium may be used.

2. Description of the Related Art

In order to convert the hot metal from a blast furnace or the molten cast iron metal from cupola (both these two metals are hereinafter referred to as hot metal) into steely the carbon, silicon and manganese present in the hot metal have to be removed. Similarly, sulphur content of the hot metal has to be decreased so that steels of a better quality or with a higher value, can be produced.

The removal of carbon, silicon and manganese from the hot metal in a steel plant is usually accomplished in a steel making unit, such as: basic oxygen furnace, open hearth furnace, etc. If the process of pre-treatment of hot metal is adapted, the metallurgical work to be done to remove carbon, silicon, and manganese in the steel making units is partially accomplished during the pre-treatment and also the sulphur is removed to an acceptable level before the hot metal is processed in a steel making units This In the pre-treatment processes used thus far, the removal of carbon, silicon and manganese is accomplished through the addition of mill scale and/or is followed by oxygen lancing of the hot metal kept in a ladle or a reaction vessel. Besides in such processes, the removal of the silicon and of the sulphur is accomplished in separate stages or vessels with successive slag removal each time, producing a stoppage in the movement of the ladle or the hot metal.

Also, in such pre-treatment processes, the amount of silicon that can be removed is rather limited (about a maximum of 0.2%). On the other hand, the oxygen lancing which can produce higher desiliconisation or decarbonisation, also results in a loss of iron into the slag phase as iron oxide and also generates significant amount of fumes.

At present, the removal of sulphur from the hot metal is accomplished, in most instances, by introducing magnesium in the molten hot metal since magnesium is the most efficient reagent for removing sulphur.

The solubility of magnesium in the molten iron is limited. Besides, the recovery of magnesium and efficiency of the treatment when pure or almost pure magnesium is used, is very low, because before the magnesium can participate in the desulphurisation reactions it floats on the surface of the molten metal due to its low density. Also, being combustible, it immediately burns.

If the magnesium is plunged into the hot metal, it vapourises as soon as it is brought in contact with the hot metal. The vapourisation leads to a very large increase in the volume of magnesium and, as a result, the plunging treatment with magnesium results in an explosively violent reaction, wherein almost the entire volume of hot metal is ejected out of the reaction vessel at high velocity. Such a method of magnesium treatment is unsafe and is highly hazardous. Besides, this treatment is not reliable as the contact time between magnesium and the hot metal is very short. Hence the quantity of sulphur removed is practically negligible.

In order to avoid such a violent reaction, magnesium could be introduced as an alloy in the hot metal either as Mag-Coke, or Ni—Mg Alloy, or as a Fe—Si—Mg alloy. In such an instance, though the reaction is somewhat controlled making it non-vioment, the use of Ni—Mg or Fe—Si—Mg to remove sulphur is prohibitively expensive and also the plunging of the Mg-coke makes the plunging system very big and costly.

However, sulphur can be removed from the hot metal if steady and continuous source of magnesium vapour is maintained in the hot metal. At presents in one of the widely used techniques of desulphurisation, such a source of magnesium coated with less reactive materials, is suspended in a carrier gas such as nitrogen and is then injected into the hot metal with the help of a specially designed dispenser to deliver the coated granules or powder inside the hot metal. But, the technique has some inherent problems, such as availability of the high purity nitrogen; and the loss of unreacted magnesium as its vapour would tend to react chemically with nitrogen and is also physically carried up along with nitrogen as it bubbles up, without fully reacting with the sulphur in the hot metal. This causes lower efficiency of magnesium utilisation for sulphur removal.

Such a source of magnesium vapour can also be produced by impregnating magnesium into a pre-heated porous refractory material by dipping and soaking the material in molten magnesium. Subsequently, the refractory material is plunged into the molten iron to release the magnesium soaked in the refractory material.

Alternatively, the magnesium can be contained in a special chamber at the bottom of a special reaction vessel called 'converter'. The magnesium is inserted in the chamber of the converter when it is empty. After, the converter is filled with hot metal, the magnesium melts and is released through the hot metal producing desulphurisation. This needs expensive capital equipment.

In yet another method, the magnesium can be contained in a plunger head with its open end threaded and finally closed with a threaded plug and with its wall containing perforations, through which the magnesium vapour escapes after the plunger is dipped and held in the hot metal. This needs a new plunger head for every treatment.

In yet another method, the open end of the plunger head is closed with a disc shaped piece made using refractory material. The plunger head is lowered independently of the ladle cover and the head is made to contact the bottom of the ladle and kept pressed against the bottoms in physical contact with it. Even though this plunging operation process is simple the plunger head used in such a process is expensive, due to the expensive material and fabrication required for its making. Besides the plunger head often breaks before the reaction is complete. Also, in such plunging operations, the plunger head breaks after every treatment for several reasons. First, the thermal expansion of the plunger rod and head produces mechanical load on the plunger head when kept pressed against the bottom of the ladle, during plunging. Secondly, the breakage also occurs since the turbulence in the molten iron produced by the expanding magnesium vapour, shakes the ladle and transmits the mechanical load to the plunger head, because it is kept pressed in physical contact with the bottom of the ladle. Since the plunger can not be reused, and is itself of desulphurisation by magnesium treatment.

A primary object of the present is to propose an improved process for the removal of silicon, manganese and sulphur from molten high carbon ferrous metal in a single reaction vessel.

Another object of the present invention is to propose an improved process for the removal of silicon, manganese and sulphur from molten high carbon ferrous metal in a single step effectively and economically without the fume generation or a significant drop in temperature.

Yet another object of the present invention is to propose an improved process for the removal of silicon, carbon, manganese and sulphur all together from molten high carbon ferrous metal in a single step, wherein the reversion of the sulphur removed earlier from the hot metal back into hot metal from the sulphur-rich slag produced is negligible, even after its prolonged holding in contact with the slag or even after the hot metal is intimately mixed with the slag brought about by relading or by charging into a basic oxygen furnace.

Yet another object of this present invention is to propose an improved process for the pretreatment of hot metal for removing silicon, manganese and sulphur all together from molten high carbon and ferrous metal, in a single reaction vessel effectively, economically without hazardous reaction and using inexpensive minerals and chemicals.

Yet another object of the present invention is to propose an apparatus for the pre-treatment of hot metal for the simultaneous removal of silicon, manganese and sulphur from molten high carbon ferrous metal, wherein the quantity of hot metal in the reaction vessel increases thereby, increasing the amount of the hot metal produced.

Still another object of the present invention is to propose an apparatus for carrying out the above mentioned process, and wherein the plunging of magnesium is effected in a controlled manner, which achieves desulphurisation and helps the recovery of iron from the iron oxide present in the slag phase.

SUMMARY OF THE INVENTION

The present invention provides an improved process for the removal of silicon, carbon, manganese and sulphur in a single reaction vessel (ladle) which comprise:

a. adding a mixture of iron oxide bearing material and a flux into a ladle;

b. adding high carbon molten ferrous metal (hot metal) into the said mixture for oxidation of silicon, carbon and manganese present in the hot petal, the reaction resulting in the formation of gaseous product and a slag which floats on the surface of the molten metal;

c. introducing magnesium metal contained in a perforated plunger head having a plurality of holes on its sides and the bottom end of said plunger head being closed so as to introduce magnesium into the hot metal;

d. gradually lowering the plunger into the hot metal till it contacts the bottom of the ladle;

e. lifting the plunger to a position upon contacting the bottom of the ladle, so that a gap is defined between the bottom of the ladle and the head of the plunger ranging between 5 to 50 mm;

f. causing a desulphurisation of the hot metal by the gradual release of the magnesium vapour from the holes of the plunger head though the hot metal;

g. the intimate mixing of the hot metal and the unreacted iron oxide present in the slag, and the turbulence produced during the release of the magnesium vapour, resulting in further oxidation of silicon and manganese and consequently further reduction of iron oxide into iron; and h. removing the slag at the completion of the reaction by any conventional method.

The apparatus of the present invention comprises a plunger having three parts, an upper steel plunger rod provided at its upper end with a counter weight and a hook lifting a cover, said upper plunger rod having a plurality of horizontal circular grooves, a lower plunger rod with an inner core of steel and with a refractory material coated at its outside, a plunger head having a plurality of holes on its sides with its bottom closed by a stepped lid with the step which fits into the recess of the plunger head, all the above three parts being joined to form a single structure, a steel cover securedly seated on the ladle and fastened at its four corners by ropes to a hook, the inside surface of steel cover being coated with a refractory material, the cover also being provided with vent pipes for the release of excess gases and fumes, a lock and lift assembly consisting of a base plate having an opening through which the upper plunger rod is movably fixed to said cover of the ladle, a pair of jaws provided with horizontal semi-circular grooves in its inner cylindrical surface which matches with the grooves provided at the upper end of the upper plunger rod movably fixed to the base plate, means being provided on each side of the base plate for moving the jaws against each other in a plane at 45° so as to grip the plunger at the end of its travel and lock the same to the cover.

In accordance with the process of the present invention, silicon, carbon and manganese is removed from the hot metal by adding iron oxide containing material to it. The iron oxide present in the material partly reacts with the silicon, manganese and carbon present in the hot metal and is itself reduced to produce iron which combines with the molten hot metal. The unreacted iron oxide thereafter goes to the slag phases floating on the surface of the hot metal The iron oxide present in the slag phase is further reduced to iron due to the intimate mixing produced by the turbulence created during the plunging of magnesium to accomplish the desulphurisation reaction. As a result, some more iron oxide is again reduced to irons which mixes with the molten hot metal. This increases the quantity of iron present in the reaction vessel, while simultaneously accomplishing the decarburisation, desiliconisation, demanganisation and desulphurisation from the hot metal in the same ladle.

The apparatus of the present invention has been developed based on the principle that when the plunger, consisting of the plunger rod and the plunger head, which is movably fixed to the cover of the reaction vessel (hereinafter referred to as ladle), is pressed down to touch the bottom of the ladle, a lock and lift system lifts the plunger such that a gap is created between the bottom of the ladle and the plunger head and locks and plunger to the cover which is secured to the ladle.

The lock and lift phenomenon can be accomplished by a variety of methods. In the preferred embodiments it can be accomplished by two jaws which are movable towards each other in a plane inclined at 45°, on the top of the cover of the ladle. As the jaws move towards each other to grip the plunger rod, they lift it up and then lock the rod to the cover of the ladle. When the jaws fixed on the cover are joined to the rod, they make it an integral part of the cover of the ladle. The movement of the jaws can be effected electromechanically, pheumatically or hydraulically, as per convenience.

According to the invention, the plunger is kept pressed against the bottom of the ladle, by adapting the upper end of the plunger to move freely in the annular hole provided in the cover of the ladle. When the plunger head touches the ladle bottom, the lock and lift system is actuated, by a suitable mechanism and a drive and as a results the plunger is lifted and then locked to the steel shell of the cover of the ladle. Since the lock and lift assembly is rigidly connected to the cover of the ladle, the plunger becomes an integral part of the apparatus. Any suitable and convenient assembly can be provided to have the lock and lift effects.

The dead weight provided on the plunger head is so adjusted that the plunger head moves down into the ladle containing the hot metal in a controlled manner smoothly and does not suffer any breakage when it makes contact with the bottom of the ladle. As soon as the plunger head rests over the bottom of the ladle, electrical drive on the cover is switched on which moves the jaws towards the plunger rod. As a result, the plunger rod together with the head gets lifted and then locked to the cover of the ladle.

The present invention is based on an altogether new approach wherein the highly reducing and the highly oxidizing reactions are conducted at two different sites within the same reaction vessel. Thus, the removal of sulphur is accomplished at the bottom of the reaction vessel whereas, the removal of silicon, manganese and carbon are achieved at the top layer of the molten metal where slag is present. Accordingly$ in this invention, highly differing conditions of the reactions are accomplished together, in the same reaction vessel.

Due to the lock and lift system provided in the apparatus of the present invention, as explained above, a gap is created between the plunger head and bottom of the ladle which prevents any transmittance of force to the plunger head, either produced by the vibration of the ladle during plunging, or due to the thermal expansion of the heated plunger rod locked into the bottom of the ladle.

DESCRIPTION OF THE PREFERRED EMBODIMENTS

Figure 1:
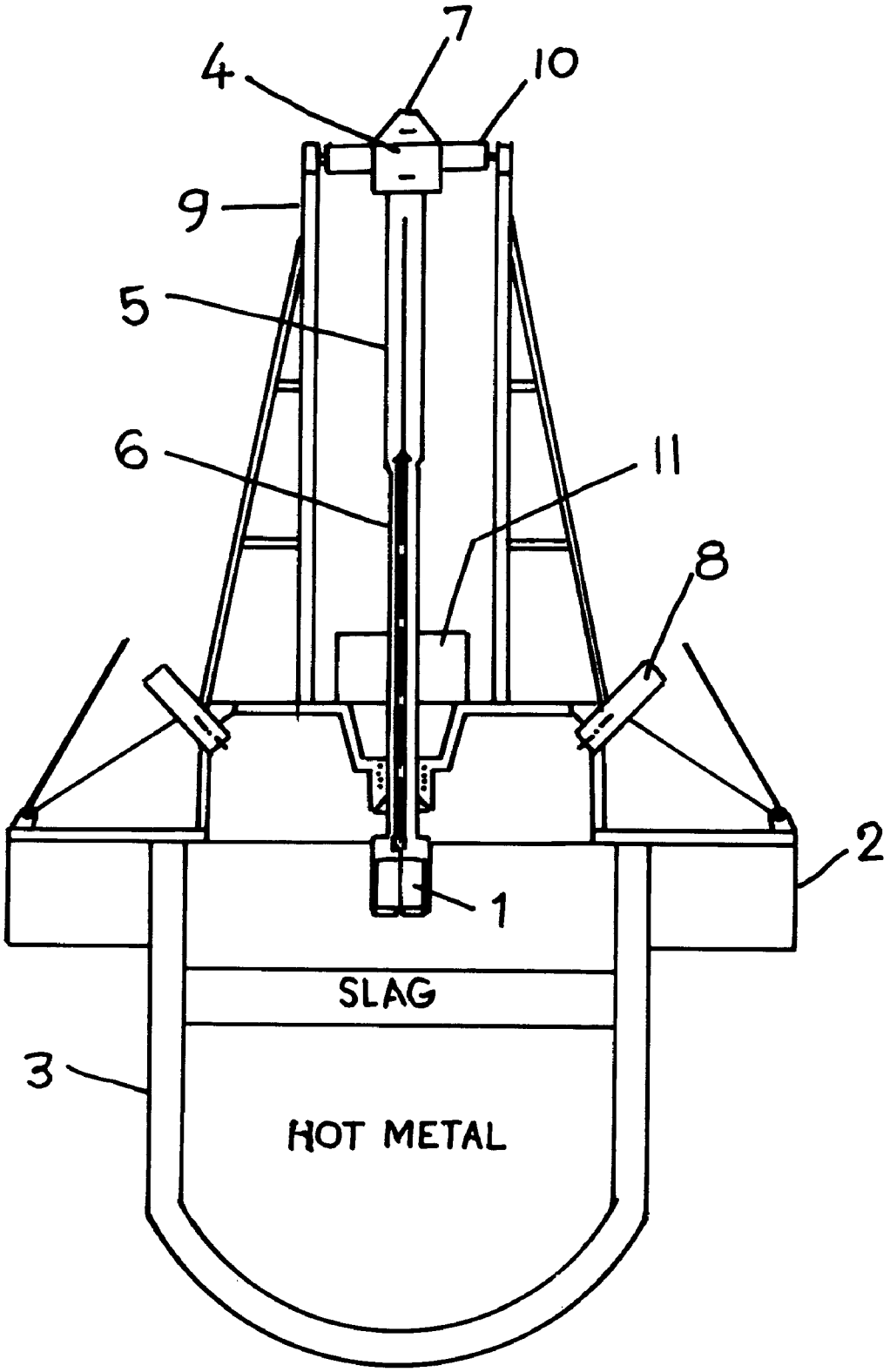
FIG. 1 of the drawings illustrates the cross section of one embodiment of the assembly of a cover of the ladle, the plunger, and the ladle, as provided in the present invention, and the location of the lock and lift assembly.
Figure 2:
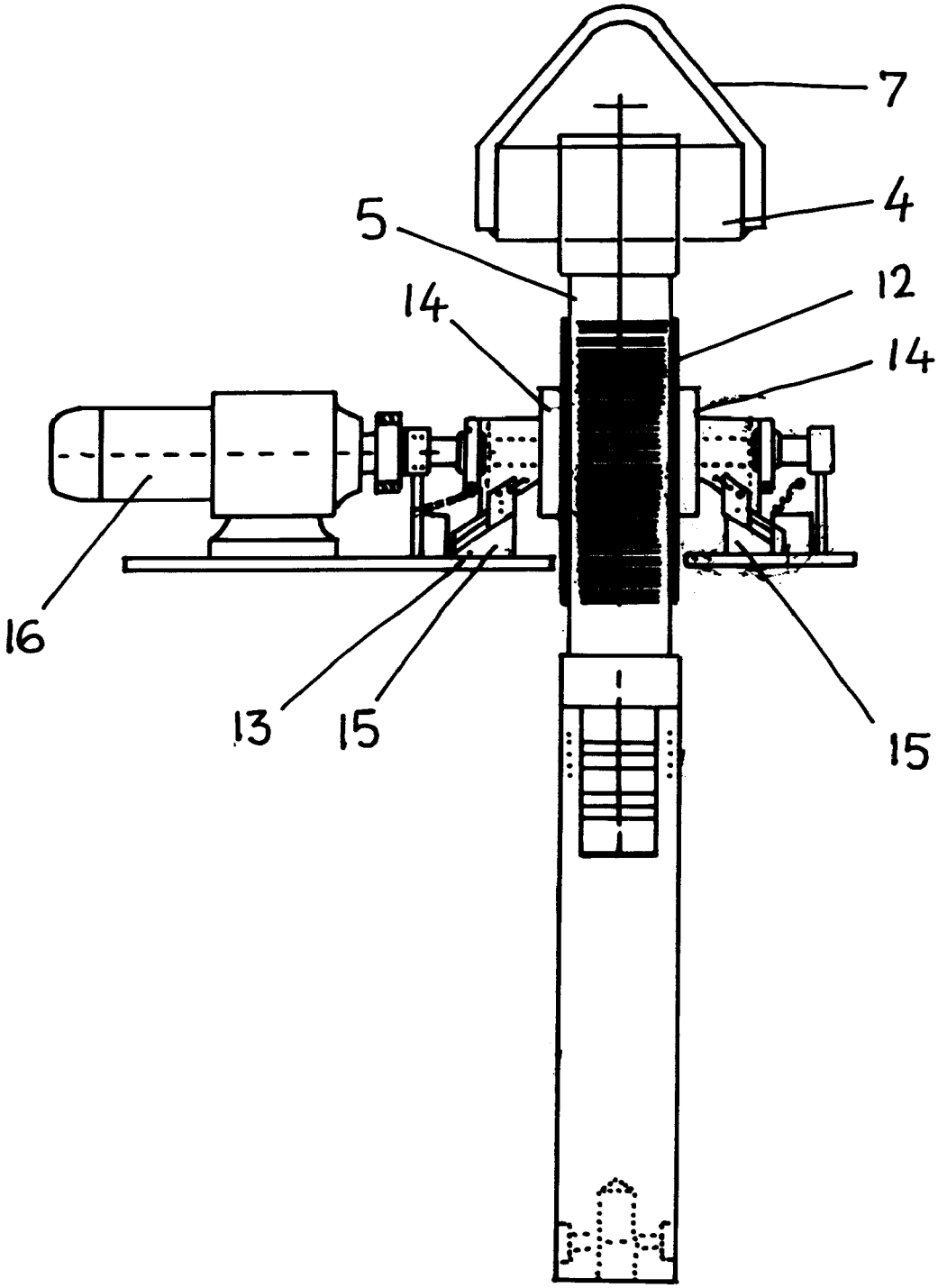
FIGS. 2 and 3 illustrates the front and plan view respectively of the lock and lift system incorporated in the apparatus of the present invention.
Figure 3:
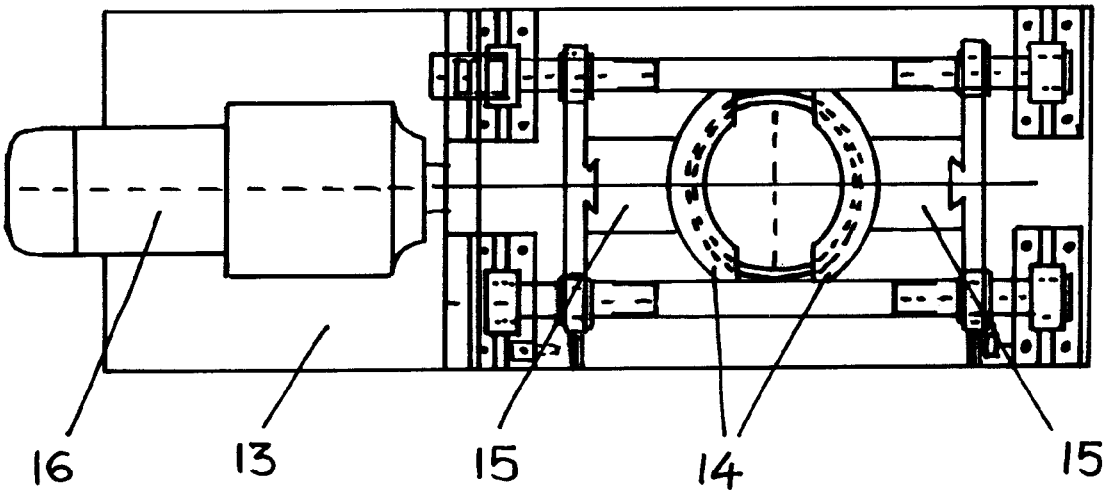

The apparatus of the invention is described with reference to the FIGS. 1,2 and 3 which is one embodiment of the invention. As explained earlier, many other mechanisms can be employed and is within the perview of this invention, for effecting the lock and lift effect to the apparatus. FIGS. 1 shows that the cover 2 of the ladle rests on the ladle 3. The plunger consists of an assembly of three parts, the upper plunger rod 5, the lower plunger rod 6, and the plunger head 1. A counterweight 4 on the top of the plunger is so adjusted that when the hook is lowered the plunger descends gradually into the hot metal.

The cover of the ladle is provided with vent pipes 8 for the release of exhaust gases/fumes formed during the reactions. Plunger guide system 9 is welded/fixed detachably over the top of the cover 2. The two guide plates 10 slide along the guide posts 9. The movement of guide plates within the guide posts, permit only a vertical movement of the plunger. The lock and lift assembly 11 is used for the locking and lifting of the plunger after it has been lowered and after it contacts the bottom of the ladle.

The plunger head 1 in FIG. 1 may be kept at a distance ranging from 5 to 50 mm from the bottom of the ladle in a number of ways, while the plunger is firmly secured to the ladle cover 2. The ladle cover 2 is seated securedly on the ladle 3. For this, the cover is usually attached with a dead weight to make the cover sufficiently heavy, so that magnesium vapour is not able to lift the plunger with crucible. Alternatively, the ladle cover is made light (only sufficient for structural rigidity) and it is locked with the foundation or the structures or pressed over the ladle with pneumatic/hydraulic cylinders. Positive mechanical locking of the ladle cover with other rigid structures, properly founded on the ground, also serves the purposes.

It would be observed that the plunger head 1 is kept at a distance from the bottom of the ladle with the open end of the plunger head at its bottom, closed by a detachable lid (or plug) which has a step. This step has a diameter slightly smaller than the diameter of the recess in the cylindrical plunger head enters into the recess locked at the bottom of the plunger head. The step, therefore, enters into the recess of the plunger head. The lid continues to stay in position at the ladle bottom and keeps the open end of plunger closed during the process, even after the plunger is lifted by 5 to 50 mm. The lid stays in position since the step provided in the lid has a height of 25 to 50 mm. The diameter of the lid (or plug) is equal to or larger than the external diameter of the cylindrical plunger head.

One embodiment of the lock and lift assembly is illustrated in fiture 2 and 3, which mainly consists of grooved upper plunger rod 5, fixed inclined blocks 15, base plate 13, geared motor 16, grooved sliding jaws 14 and counter weight 4.

Refractory coated lower plunger rod 6 as shown in FIG. 1 is fixed to the plunger head 1 and this is then assembled to the upper plunger rod 5. Base plate 13 is mounted over a suitable frame on the top of the ladle cover.

According to a feature of the invention, plunger head 1 is firmly fixed to the plunger rod either through threaded joints or through cotter or fixing bolts. The disc shaped lid (or the plug) made by using refractory material and/or steel, is used to close the opening at the bottom of the plunger head. The lid must be fastened at the open end at the bottom of the plunger head after the magnesium is placed inside the plunger head. The lid holds the magnesium inside and prevents direct contact between the molten metal and magnesium, while the plunger is lowered and also while it is held at a distance of 5 to 50 mm above the bottom of the ladle. To positively secure the lid into the plunger head, a step of 25 to 50 mm height is provided on one surface of the disc-shaped lid. The step enters into the recess and matches with the inner diameter of the plunger head. The step prevents the lid from sliding out, while the plunger is lowered and also after the lock and lift assembly lifts the plunger during the reaction.

According to another feature of the invention, the refractory coated lower plunger rod 6 is assembled and fastened to an upper plunger rod 5 which is a grooved cylindrical steel piece. The grooved part of the upper plunder rod is held firmly by the grooved sliding jaws 14, with the grooves in their inner surfaces match with those in the upper plunder rod. The jaws move back and forth actuated electromechanically or pneumatically or hydraulically in a plane inclined at 45° above the ladle cover. The motion of the actuators and consequent engagement with the grooved cylindrical part of the upper plunger, ensures the operation of lock and lift system.

When the lock and lift system is idle, there is sufficient clearance between the grooved jaws 14 and the upper plunger rod 6 for a free vertical movement of the upper plunger rod without interference. After the cover is placed on the top of the ladle and plunger head 1 is lowered gradually to seat over the bottom of the ladle, the electrical drive is switched on (in the case of electromechanical actuation of the system, as illustrated in FIGS. 2 and 3). This gives an inclined movement to grooved jaws 14 through appropriate mechanism and linkages. The grooved jaws 14 and grooved upper plunger rod 6 are so designed that after locking, the shaft is lifted up through a height which depends on the depth of the grooves Various limit switches are provided to safeguard the overload safety aspect of the system.

As a result, the treatment of the molten iron in the ladle occurs by a steady flow of the magnesium vapour which escapes from the perforations in the plunger head. The magnesium vapour also escapes through the gap, between the plunger head and the ladle bottom, whenever there is an accidental build up of the pressure of magnesium vapour within the plunger head. This gives rise to a controlled and highly reliable magnesium treatment of hot metal.

It is to be observed that the details given above regarding the construction of the apparatus should not be construed to limit the scope of the invention as any modification within the ambit of the invention is also contemplated by the present invention. In other words, the mechanism shown for effecting the lock and lift principles is only illustrative and not limited to the system explained.

The details of carrying out the invention utilising the apparatus proposed is explained below:

A mixture consisting of iron oxide bearing material is heated to a temperature of 200 to 400° C. The mixture is placed in the ladle and the hot metal at a temperature of about 1350 to 1500° C., is added to the above said mixture in the ladle. The reaction between the hot metal and the mixtures takes places Magnesium metal is put inside a can. The can is then inserted into plunger head 1. Afterwards, plunger head 1 is closed by the disc shaped plunger lid with the step of the lid inside the plunger head. The plunger lid is fastened to the plunger head. After this, the cover of the ladle is made to sit secured onto the ladle. The plunger is then lowered into hot metal inside the ladle, till it touches the bottom of the ladle. A turbulence is created in the hot metal inside the ladle due to the upward movement of the expanding magnesium vapour. Immediately on touching the bottom, the plunger is lifted so as to create a gap between the bottom of the ladle and the plunger head in the range of 5 to 50 mm. This is achieved by moving the grooved jaws by switching the drive. This turbulence inside the metal produces intimate mixing of the silicon, manganese and carbon of the hot metal with the unreacted iron oxide contained in the slag at the top of the metal. The removal of silicon, manganese and carbon and the recovery of iron, are achieved by the reduction of the iron oxide in the slag phase, which takes place all along. The reaction of the magnesium vapour with the hot metal produces excellent desulphurisation, as the magnesium vapour intimately interacts as it moves up in a controlled manner through the hot metal.

After the magnesium plunging is over, the plunger is withdrawn and the cover is removed from the ladle. The temperature drop due to magnesium plunging is negligible. The removal of silicon, manganese, carbon and sulphur is evident from the analysis of the hot metal after the reaction is complete.

Afterwards, the slag is removed by conventional method with the help of a Deslagging Unit and the hot metal can be charged into the basic oxygen furnace to convert it into low sulphur, high quality steel.

The point that reversion of sulphur from slag to metal in this invention is negligible, is evident from the following: a ladle was made to wait for two hours after magnesium plunging. Thereafter the entire slag and the hot metal was charged into another ladle which caused an intimate mixing between the sulphurrich slag and the hot metal. Even after such waiting and mix-up, the sulphur in the hot metal did not increase. This result demonstrates that unlike in all other desulphurisation processes, no sulphur reversion occurred during such prolonged holding and mixing, in the present invention.

THE INVENTION HAS THE FOLLOWING ADVANTAGES

Simultaneous desiliconisation, demanganisation, decarbonisation and desulphurisation of the hot metal in a single vessel with only one deslagging at the end. This makes the process simple, economical, easy to implement and enables its convenient integration in any system of the transfer of hot metal from the iron making to the steel making unit, that may exist in a steel plant. As a result, the transfer can be accomplished faster and without the use of the mixer unit which is used to store hot metal enroute to the steel making unit in a steel plant.

The reactions in the process are controlled and are free from the usual hazards of magnesium plunging processes.

The slag produced due to the desiliconisation and demanganisation need not be removed prior to the desulpheurisation, which is done in other pre-treatment process.

The introduction of magnesium into the molten metal is smooth and controlled.

A very high degree of desulphurisation can be achieved.

The reversion of sulphur which occurs in all other processes after the hot metal is desulphurised, is almost absent in the present invention. Also the temperature drop during the treatment was negligible. Both these features impart a great deal of flexibility in transporting the pre-treated hot metal, by-passing the mixer inside a steel plant.

Since the temperature drop in the process of the invention is low, the desulphurisation can be carried out even when the hot metal temperature is low.

The quantity of magnesium used to accomplish a given amount of desulphurisation is very low.

A very high degree of desiliconisation can be achieved without the generation of fumes.

Due to less temperature drop of hot metal, the hot metal after the pre-treatment can be charged at a higher temperature into the steel making unit, resulting in higher productivity of steel from the unit.

The process uses very inexpensive oxidizing agent such as iron are/sinter fines/mill scale.

The process recovers a substantial part of the iron from the iron oxide bearing material and then transfers it into the hot metal, the value of the iron recovered can effectively defray the cost of desulphurisation, making the process still more inexpensive.

Locking and lifting of the plunger used for pre-treatment of hot metal prevents breakage of the plunger and its head due to mechanical damage and enables their repeated use mitigating the cost, maintenance and operational problems Violent reaction between hot metal and magnesium is avoided since the the plunger head is closed with a lid throughout the magnesium plunging reaction.

The apparatus of the invention used, enables repeated use of the same plunger head without breakage and a very controlled release of magnesium vapour through the hot metal.

Reference is now made to the prior art involving the step of magnesium plunging. Even though the above process of the known art involves magnesium plunging, it differs very significantly from the present invention in four respects. First, the purpose of the known art is to produce spheroidal graphite (ductile) or compacted graphite iron, whereas the purpose of the present invention is to remove silicon, manganese, carbon together with sulphur from the hot metal. Second, the purpose of magnesium plunging in the known art is to render the graphite in the solidified cast iron, into a spheroidal or a compacted form, whereas the purpose of magnesium plunging in the present invention is to remove sulphur from the hot metal and to produce turbulence inside hot metal which promotes intimate mixing between slag and metal which, in turn, accomplishes the final part, of the desired removal of silicon, manganese and carbon which is otherwise rather difficult to remove. Third, in the known art the iron oxide containing material and flux are not added, whereas these are added in the present invention together with magnesium plunging, to accomplish the removal of silicon, carbon and manganese along with that of sulphur in the same reaction vessel. Fourthly, the apparatus used in the known art, keeps the plunger head, in physical contact and pressed against the bottom of the ladle, during the reaction, whereas the apparatus used in the present invention, lifts and then locks the plunger to ensure that there is no physical contact between the plunger head and the bottom of the ladle, during the reaction.

Further, the introduction of magnesium by the present invention as against by all the methods earlier, requires expensive equipment and consumables.

Similarly, the removal of silicon, manganese and carbon using the methods of the prior art described hereinabove involves several separate steps. These methods also involve relading and deslagging, thereby making the process for the removal of silicon, manganese and carbon rather complicated and expensive.

The reason for the use of several steps and deslagging as mentioned above, is explained below:

The removal of silicon (as also manganese and carbon) from molten metal for the manufacture of steel requires that the oxygen potential in the hot metal be very high ($-10^{-4}$). On the other hand, removal of sulphur requires that the oxygen potential be very low ($-10^{-13}$). In other words, removal of silicon from hot metal requires an oxidizing atmosphere, whereas the removal of sulphur requires a highly reducing atmosphere. As a result, it is commonly believed that the silicon and sulphur present in the hot metal cannot be removed all together in the same reaction vessel.

Currently, there is no process known to remove silicon, manganese and carbon together with sulphur, from the hot metal in a single reaction vessel without deslagging and or reladling.

If silicon, carbon, manganese and sulphur are removed together in a single reaction vessel without reladling and deslagging, the cost decreases, the ladle moves smoothly with fewer stoppages inside the plant, the temperature drop is minimised and the number of operations is decreased.

What is claimed is:

1. A process for removal of silicon, carbon, manganese and sulfur in a single reaction vessel, comprising:

a. adding a mixture of iron oxide bearing material and a flux to the reaction vessel;

b. adding high carbon molten ferrous metal to the mixture in the reaction vessel to provide hot metal and allowing an oxidation reaction to occur which oxidizes silicon, carbon and manganese present in the hot metal and results in the formation of a gaseous product and a slag which floats on the surface of the molten ferrous metal;

c. introducing magnesium metal contained in a perforated plunger head having a plurality of holes on its sides and a closed bottom end into the hot metal by gradually lowering the perforated plunger into the hot metal until the perforated plunger contacts the bottom of the reaction vessel;

d. lifting the perforated plunger by a preselected distance upon contacting the bottom of the reaction vessel so that a gap is defined between the bottom of the reaction vessel and the head of the plunger which ranges between 5 to 50 mm;

e. causing desulfurization of the hot metal by gradually releasing magnesium vapor through the plurality of holes of the perforated plunger head into the hot metal;

f. further oxidizing the silicon and manganese, and consequently further reducing iron oxide into iron, by the intimate mixing of the hot metal and unreacted iron oxide present in the slag and by turbulence produced during releasing of the magnesium vapor; and g. removing the slag at the completion of the oxidation reaction.

2. The process as claimed in claim 1, wherein the iron oxide bearing material is at least one material selected from the group consisting of iron ore, blue dust, mill scale, and sinter.

3. The process as claimed in claim 2, wherein the flux is selected from the group consisting of lime, flurospar, and rice husk.

4. The process as claimed in claim 3, wherein the perforated plunger head additionally contains aluminum.

5. The process as claimed in claim 4, further comprising preheating the mixture to a temperature ranging from 200 to 400° C. prior to adding the mixture to the reaction vessel.

6. The process as claimed in claim 5, wherein the plunger head is lifted to a preselected height which is greater than the preselected distance to which the plunger head is lifted.

7. The process as claimed in claim 1, wherein the flux is selected from the group consisting of lime, flurospar, and rice husk.

8. The process as claimed in claim 7, wherein the perforated plunger head additionally contains aluminum.

9. The process as claimed in claim 8, further comprising preheating the mixture to a temperature ranging from 200 to 400° C. prior to adding the mixture to the reaction vessel.

10. The process as claimed in claim 9, wherein the plunger head is lifted to a preselected height which is greater than the preselected distance to which the plunger head is lifted.

11. The process as claimed in claim 1, wherein the perforated plunger head additionally contains aluminum.

12. The process as claimed in claim 11, further comprising preheating the mixture to a temperature ranging from 200 to 400° C. prior to adding the mixture to the reaction vessel.

13. The process as claimed in claim 12, wherein the plunger head is lifted to a preselected height which is greater than the preselected distance to which the plunger head is lifted.

14. The process as claimed in claim 1, further comprising preheating the mixture to a temperature ranging from 200 to 400° C. prior to adding the mixture to the reaction vessel.

15. The process as claimed in claim 14, wherein the plunger head is lifted to a preselected height which is greater than the preselected distance to which the plunger head is lifted.

16. The process as claimed in claim 1, wherein the plunger head is lifted to a preselected height which is greater than the preselected distance to which the plunger head is lifted.

17. The process as claimed in claim 1, wherein the magnesium metal contained in the perforated plunger head is introduced as chips.

18. An apparatus for removal of silicon, carbon, manganese and sulfur in a single reaction vessel, comprising:

a. a reaction vessel;

b. a plunger having three parts joined to form a single structure including:

i. an upper steel plunger rod provided at the upper end of the plunger with a counter weight and a hook for lifting a cover, the upper steel plunger rod having a plurality of horizontal circular grooves provided therein;

i.i. a lower plunger rod having an inner core comprised of steel and having an outer coating comprised of a refractory material; and i.i.i. a plunger head having a plurality of holes on its sides, having a recess, and having a closed bottom provided by a stepped lid having a step which fits into the recess of the plunger head;

c. a steel cover having four corners, the steel cover being securely seated on the reaction vessel and fastened at the four corners thereof by ropes to a hook, the steel cover having an inside surface which is coated with a refractory material, and the steel cover being provided with vent pipes for the release of excess gases and fumes; and d. a lock and lift assembly consisting of:

i. a base plate having an opening through which the upper plunger rod is moveably fixed to the steel cover of the reaction vessel,;

i.i. a pair of jaws provided with horizontal semi-circular grooves in inner cylindrical surfaces thereof, which horizontal semi-circular grooves match with the grooves provided at the upper end of the upper plunger rod which is moveably fixed to the base plate; and i.i.i. means provided on each side of the base plate for moving the pair of jaws against each other in a plane at 45° so as to grip the plunger at the end of its travel and lock the plunger to the steel cover.

19. The apparatus as claimed in claim 17, wherein the pair of jaws move at an angle ranging from 30 to 60°.

* * * * *